US005899419A

United States Patent [19]

Ross et al.

[11] Patent Number: 5,899,419

[45] Date of Patent: May 4, 1999

[54] BAG HOLDER

[75] Inventors: Jaye F. Ross; Ted Torok; Jeff R. Ellis, all of Virginia Beach, Va.

[73] Assignee: Buddy Systems, Inc., Virginia Beach, Va.

[21] Appl. No.: 08/935,151

[22] Filed: Sep. 22, 1997

[51] Int. Cl.[6] ..... A63B 55/04

[52] U.S. Cl. ..... 248/97

[58] Field of Search ..... 248/99, 97, 95, 248/100, 101

[56] References Cited

U.S. PATENT DOCUMENTS

| | | | |
|---|---|---|---|
| 1,266,522 | 5/1918 | Oldham . | |
| 3,747,653 | 7/1973 | Ringer . | |
| 3,754,785 | 8/1973 | Anderson . | |
| 4,157,801 | 6/1979 | Elmer . | |
| 4,270,788 | 6/1981 | Overholt . | |
| 4,299,365 | 11/1981 | Battle . | |
| 4,358,083 | 11/1982 | Haubrich . | |
| 4,413,800 | 11/1983 | Kelson . | |
| 4,548,372 | 10/1985 | Lutzker . | |
| 4,629,233 | 12/1986 | Pfisterer . | |
| 4,723,803 | 2/1988 | Sapp . | |
| 4,759,519 | 7/1988 | Cheng . | |
| 4,768,742 | 9/1988 | Kaaloa . | |
| 4,775,123 | 10/1988 | Borland et al. | 248/99 |
| 4,783,090 | 11/1988 | Moulton . | |
| 4,856,740 | 8/1989 | MacLeod et al. | 248/99 X |
| 4,874,141 | 10/1989 | Schulz . | |
| 4,940,201 | 7/1990 | Kurth . | |
| 5,014,943 | 5/1991 | Nelson et al. . | |
| 5,014,944 | 5/1991 | Malik et al. . | |
| 5,031,948 | 7/1991 | Groth et al. . | |
| 5,065,965 | 11/1991 | Aulabaugh . | |
| 5,106,041 | 4/1992 | Jelincic . | |
| 5,107,666 | 4/1992 | Rahtican . | |
| 5,139,219 | 8/1992 | Navarro | 248/97 |
| 5,180,126 | 1/1993 | Bennett . | |
| 5,183,339 | 2/1993 | Williams | 248/99 X |
| 5,222,536 | 6/1993 | Hodgdon et al. . | |
| 5,303,889 | 4/1994 | Malik et al. . | |
| 5,308,027 | 5/1994 | Fullilove . | |
| 5,393,022 | 2/1995 | Palumbo . | |
| 5,413,394 | 5/1995 | Mitchell . | |
| 5,454,535 | 10/1995 | Thomson et al. . | |

(List continued on next page.)

*Primary Examiner*—Ramon O. Ramirez
*Attorney, Agent, or Firm*—John F. Carroll IV; Thedford I. Hitaffer

[57] ABSTRACT

A bag holder for supporting bags and to aid in filling the bags with debris comprises a base, a standard extending from the base, and a Support attachable to the standard. The base, standard and support may be disassembled into a compact form. The support is removable from the standard and includes a handle by which a user may exert control. A bag is supported by the support via frictional engagement therewith. This configuration protects the mouth of the bag from coarse debris entering therein and from lawn and garden implements used to fill the bag. A portion of the support which contacts the ground is structured aid configured to conform to the surface of the ground when downward pressure is exerted against the support. The support comprises a cylindrical peripheral wall which is expandable and contractible to engage and disengage the inner surface of the mouth of a plastic bag. A flange is integral with the cylindrical wall and includes a rough surface and protrusions or nodules which frictionally engage the mouth of the bag. The support includes a clamp which is coupled to the cylindrical wall by a living hinge. The cylindrical wall and the clamp are structured and configured to engage one another when the clamp is closed to lock the support in place. A pan for use as a lawn and garden tool includes a trough for scooping up debris. The trough has an open end through which debris may be scooped up and a handle opposite the open end. A rake is disposed at the open end of the pan. The rake comprises a series of spaced fingers which are configured to comb through an irregular surface to enhance the ability of the pan to scoop up debris. It is contemplated that the pan would be carried by the bag holder. The bag holder may also include a trough to carry sundry items.

68 Claims, 10 Drawing Sheets

U.S. PATENT DOCUMENTS 5,456,431 10/1995 Ilnisky .
5,478,152 12/1995 Bogle .
5,498,046 3/1996 Ridley Sr. et al. .
5,499,787 3/1996 Bonomo .
5,513,822 5/1996 Gould .
5,513,823 5/1996 Bresnahan .
5,570,862 11/1996 Nugent .
5,588,622 12/1996 Gordon, Sr. ..... 248/99 X
5,593,117 1/1997 Alexander, III .
5,597,145 1/1997 Meyers et al. .
5,615,853 4/1997 Hearst .
5,738,315 4/1998 Kent, Jr. ..... 248/97

FIG. 13
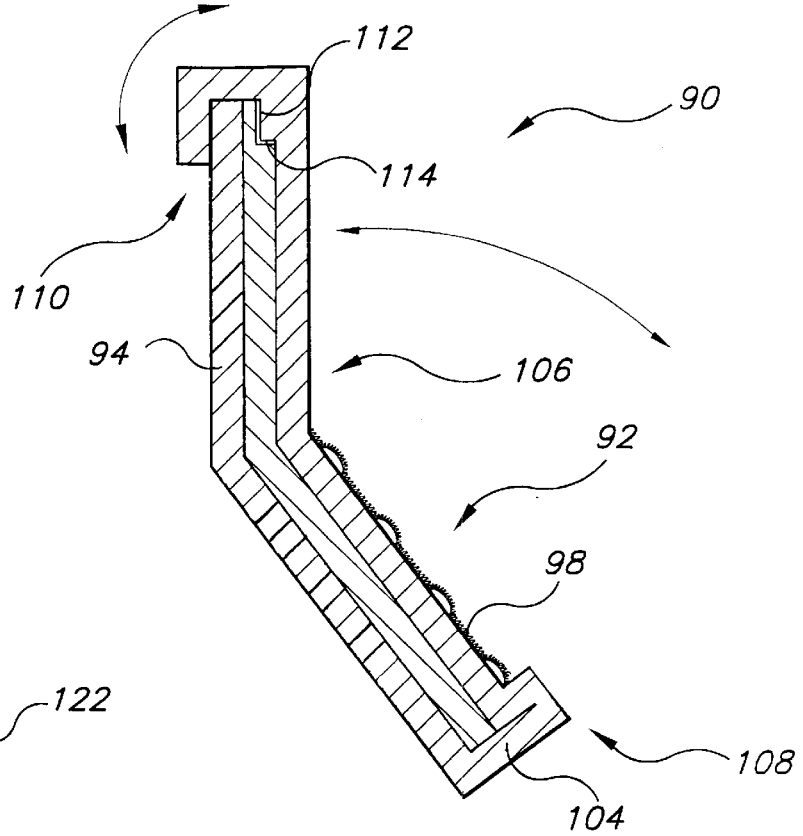
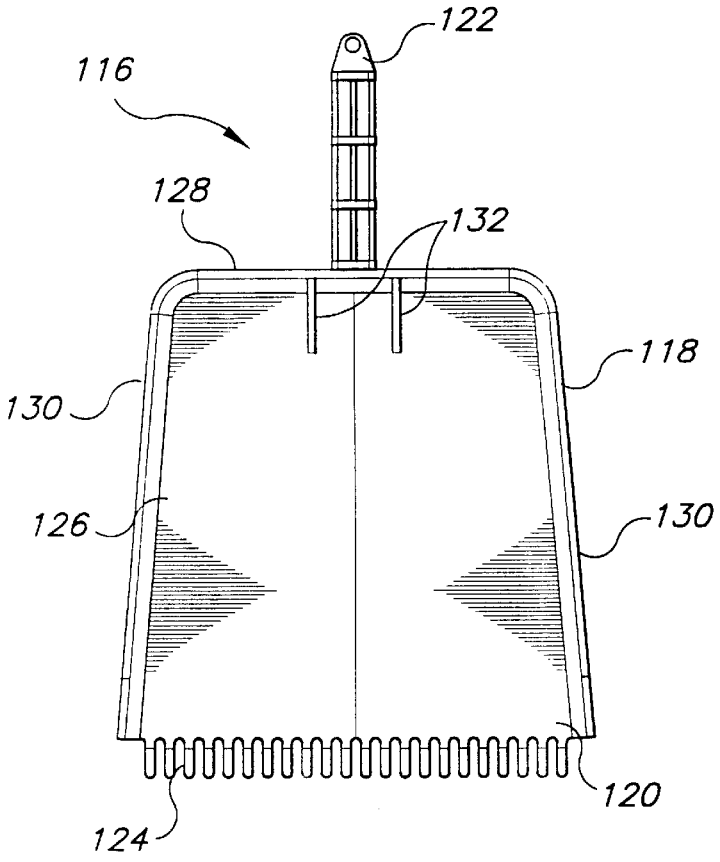
FIG. 14

BAG HOLDER

BACKGROUND OF THE INVENTION

1. Field of the Invention

The present invention relates generally to support devices and more particularly, to a substantially lightweight bag holder for holding the mouth of plastic refuse bags open and for supporting the refuse bags in horizontal or upright position, and which is capable of being broken down and stored in compact form.

2. Description of the Prior Art

Plastic bags have become extremely popular for the containment of refuse and debris. Of particular concern is the use of large plastic bags for collecting lawn and garden waste. Filling large plastic bags is generally difficult because they are awkward to hold open, especially when shoveling or raking lawn and garden waste therein. The task generally involves laying the bag on the ground, and while the bag is lying on the ground, the user holds the mouth of the bag open with one hand and shovels waste into the bag with the other hand, or with a lawn and garden tool. Attempts to address this problem have been made through the use of bag holders which hold the bags open while they are being filled. Many types of bag holders are known and used. Some comprise enclosures, such as containers with lids, while others comprise lightweight, open frames. Some bag holders are free standing while others are configured to be attached to supporting structures or surfaces. An example of a prior art bag holder is set forth in U.S. Pat. No. 5,615,853, issued Apr. 1, 1997, to Byirl J. Hearst, who discloses a flexible and horizontal bag support. U.S. Pat. No. 5,588,622, issued Dec. 31, 1996, to M Brian Gorgon, Sr., discloses a clamping ring bag holder. U.S. Pat. No. 5,570,862, issued Nov. 5, 1996, to John T. Nugent, discloses a vertical and horizontal bag stand. (See FIGS. 2 and 3.) U.S. Pat. No. 5,478,152, issued Dec. 26, 1995, to David M. Bogle, discloses a bag stand with a circular clamp. (See reference number 16*b*.) U.S. Pat. No. 5,456,431, issued Oct. 10, 1995, to Allen M. Ilinsky, discloses a circular clamping bag stand. (See FIG. 1.) U.S. Pat. No. 5,413,394, issued May 9, 1995, to Marilyn Mitchell, discloses a horizontal and upright bag stand. (See FIGS. 1, 6 and 7.) U.S. Pat. No. 5,180,126, issued Jan. 19, 1993, to Charles O. Bennett, discloses a horizontal and upright bag stand. (See FIGS. 4 and 5.) U.S. Pat. No. 5,107,666, issued Apr. 28, 1992, to Gregory Rahtican, discloses a lawn scoop and clamp. (See FIG. 4.) U.S. Pat. No. 5,031,948, issued Jul. 16, 1991, to James A. Groth et al., discloses a horizontal and upright bag holder and handle. U.S. Pat. No. 4,783.090, issued Nov. 8, 1988, to Lee A. Moulton, discloses a hoop and handle bag holder. U.S. Pat. No. 4,629,233, issued Dec. 16, 1986, to Dieter Pfisterer, discloses a horizontal and upright holder. (See FIG. 8.) U.S. Pat. No. 3,754,785, issued Aug. 28, 1973, to John E. Anderson discloses a bag holding hoop. U.S. Pat. No. 5,498,046, issued Mar. 12, 1996, to Andre T. Ridley, Sr. et al., U.S. Pat. No. 5,308,027, issued May 3, 1994, to Tom P. Fullilove, U.S. Pat. No. 5,106,041, issued Apr. 21, 1992, to James J. Jelinicic, and U.S. Pat. No. 4,768,742, issued Sep. 6, 1988, to Edward P. Kaaloa, all show various types of apertures for engaging and holding the mouth of a sack or bag open.

None of the above inventions and patents, taken either singly or in combination, is seen to describe the instant invention as claimed.

SUMMARY OF THE INVENTION

The present invention is a bag holder for supporting bags and more particularly, for supporting plastic waste bags, for example, while filling the bags with debris. The bag holder includes a base, a standard extending from the base, and a support removably attachable to the standard so as to be supported by the same. The base, standard and Support may be disassembled into a compact form for storage and reassembled for use. The support is removable from the standard and may be controlled by a handle to permit the user to place the mouth of a bag supported thereby against the ground when filling the bag with debris. A portion of the support which contacts the ground is structured and configured to conform to the surface of the ground when downward pressure is exerted against the support to cover a greater ground surface area when in use. The outer surface of the support supports a bag by frictionally engaging the bag. This configuration protects the mouth of the bag from coarse debris entering therein and from lawn and garden implements used to fill the bag. The support comprises a cylindrical peripheral wall which is expandable and contractible to respectively engage and disengage the inner surface of the mouth of a plastic bag. A flange is integral with the cylindrical wall and includes a coarse surface and protrusions or nodules which are purposed to frictionally engage the mouth of the plastic bag. The support includes a clamp which is coupled to the cylindrical wall by a living hinge. The cylindrical wall and the clamp are structured and configured to engage one another when the clamp is closed to fix the size of the support so as to maintain the support in frictional contact with the mouth of the bag supported thereby. The bag holder is also structured and configured to provide a substantially rigid and stable support for a plastic bag, even under heavily loaded conditions, at warm or cold temperatures, and in inclement weather.

The bag holder may include a pan for use as a lawn and garden tool. It is preferable that the pan include a trough for scooping up debris, such as lawn and garden waste. The trough has an open end through which debris may be scooped up and a handle opposite the open end. A unique feature of the pan is a rake disposed at the open end. The rake comprises a series of spaced fingers which are configured to comb through an irregular surface, such as a grassy surface, to enhance the ability of the pan to scoop up debris. It is contemplated that the pan would be carried by the bag holder, preferably by the base. The base may also be provided with a trough to carry miscellaneous articles, such as a supply of plastic waste bags and sundry lawn and garden implements.

Accordingly, it is a principal object of the invention to provide a bag holder for use in supporting plastic bags independently without the aid of the user and alternatively, for supporting plastic bags in a manner in which the support may be manipulated or controlled by the user by hand via a handle attached to the support.

It is another object of the invention to provide a bag support having a portion thereof structured and configured to distort and substantially conform to a work surface upon which it is being used by exerting a predetermined amount of pressure against the work surface with the support, thereby covering a greater surface area of the work surface and permitting a bag supported by the support to be filled more rapidly.

It is a further object of the invention to provide a bag support which is structured and configured to be slidably expandable to frictionally engage and support plastic bags of various sizes and which may be easily and quickly locked in a desired expanded position by an integral locking clamp.

Still another object of the invention is to provide a bag support which supports a plastic bag in a manner such as to protect the mouth of the bag against damage from debris entering the bag, or from implements, such as lawn and garden tools, used to fill the bag.

It is another object of the invention to provide a mobile bag holder that may easily be assembled for use and disassembled into a compact form for storage.

It is yet another object of the invention to provide a lawn and garden implement comprising a pan for scooping up debris and which has a rake at an open end thereof for combing through an irregular surface, such as a grassy surface, to enhance the ability of the pan to scoop up debris.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 13 an enlarged, sectional view the slidably engageable ends and a clamp coupled to the lower edge of the inner end of the peripheral wall by a living hinge showing the clamp in a closed posture with an inner nodule integral with the upper end of the clamp engaging a notch in the outer surface of the upper edge of the outer end of the peripheral wall.

FIG. 14 is top plan view of a combination rake pan according to the instant invention.

Similar reference characters denote corresponding features consistently throughout the attached drawings.

DETAILED DESCRIPTION OF THE PREFERRED EMBODIMENT

Figure 1:
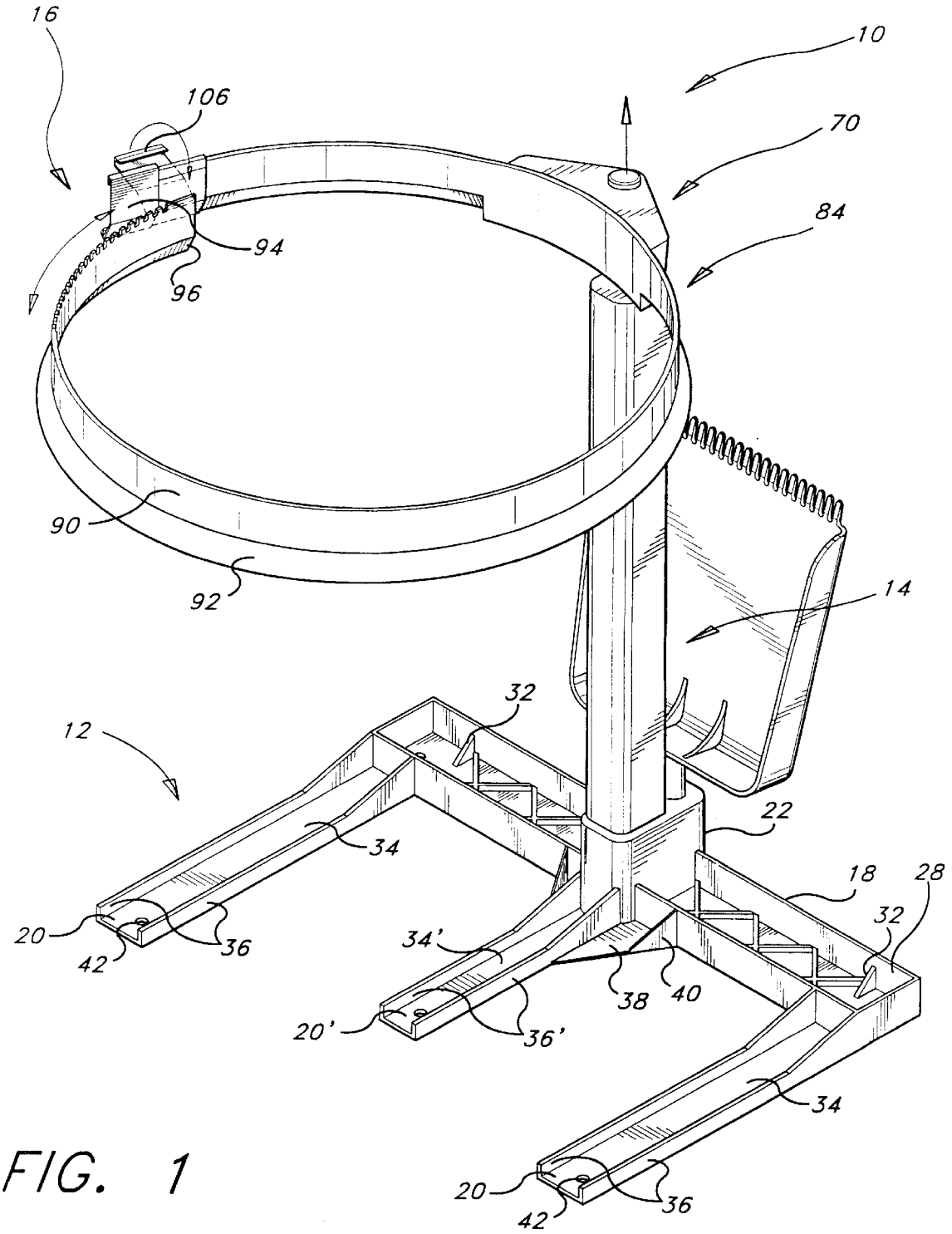
FIG. 1 is a perspective view of a bag holder according the instant invention in its assembled form and carrying a pan for use therewith.
Figure 2:
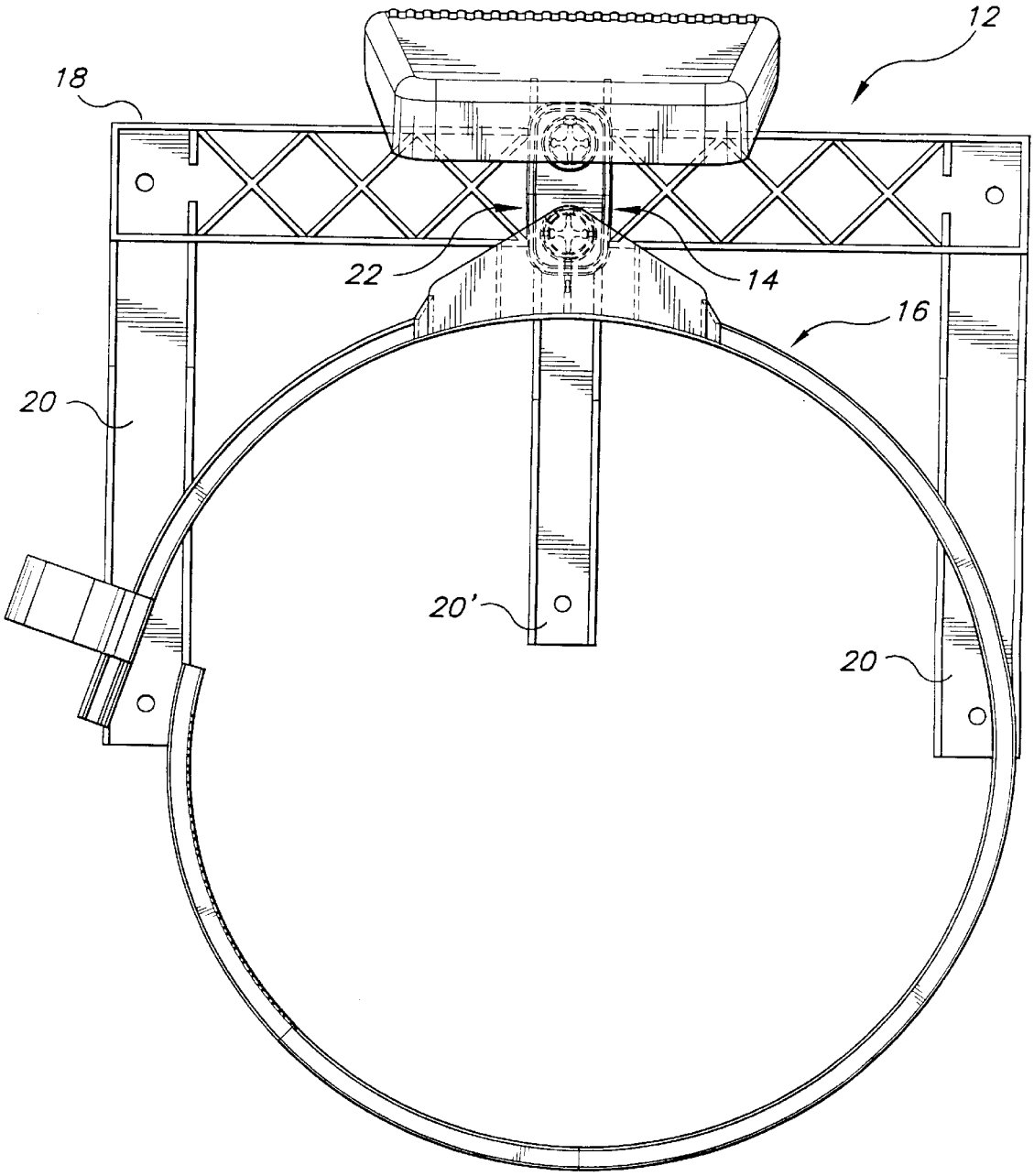
FIG. 2 is an elevational view of the bag holder and pan shown in FIG. 1

The present invention, as shown in FIGS. 1 and 2, is a bag holder 10 comprising a base 12, a standard 14, and a support 16. The base 12, standard 14 and support 16 are preferably releasably assembled together to permit the holder 10 to be broken down and stored in a compact fashion. The base 12 comprises a longitudinal posterior member 18, three branches 20, 20' extending forwardly of the posterior member 18 and a tower 22 extending upwardly from the posterior member 18.

Figure 3:
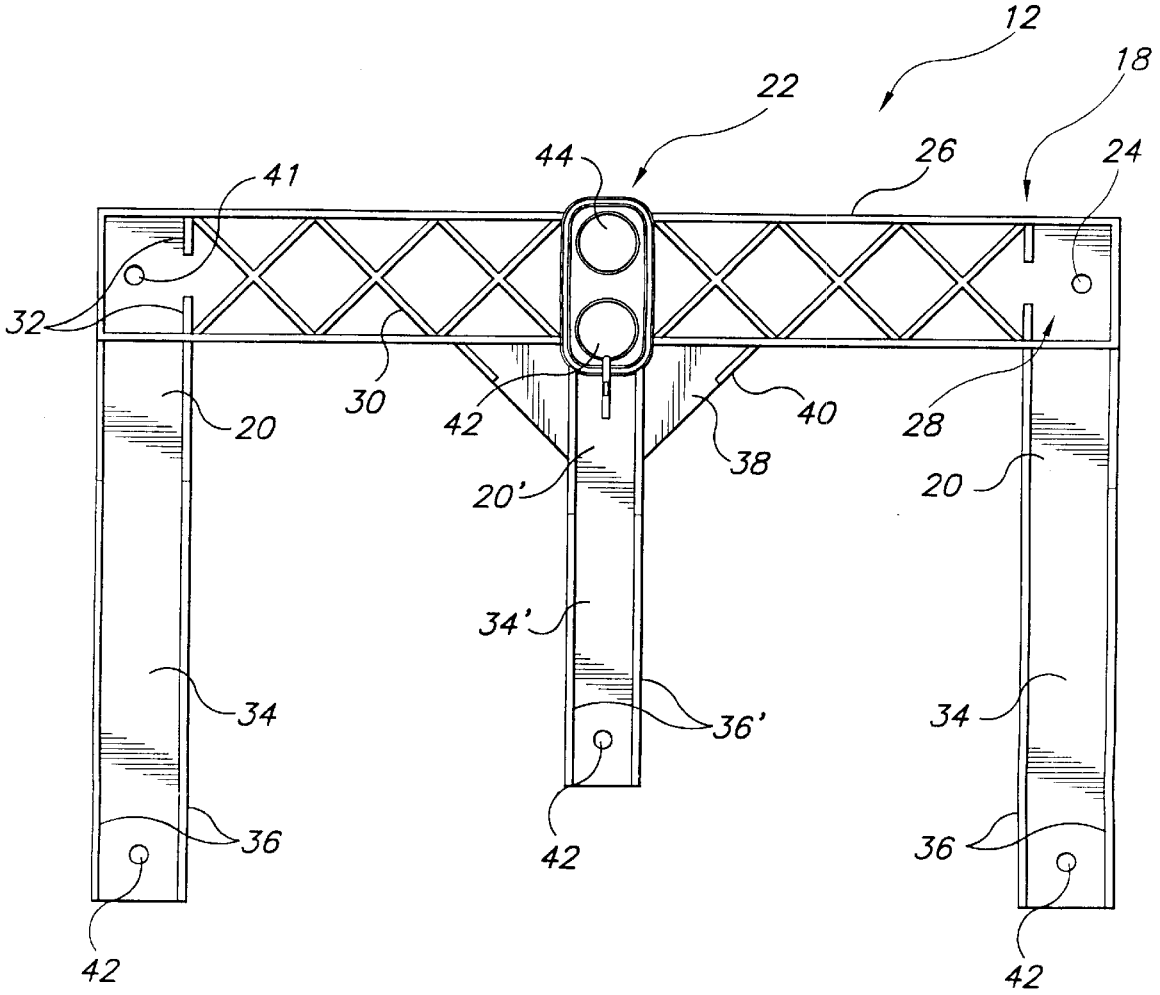
FIG. 3 is a top plan view of a base according to the bag holder of the instant invention.
Figure 4:
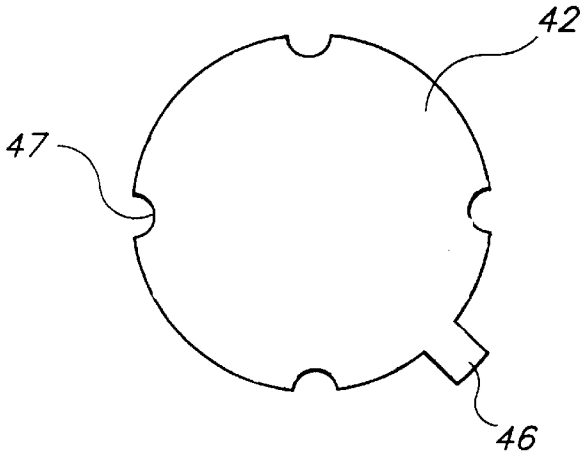
FIG. 4 is an enlarged diagrammatic representation of the top plan view of the forward bore of the tower.
Figure 5:
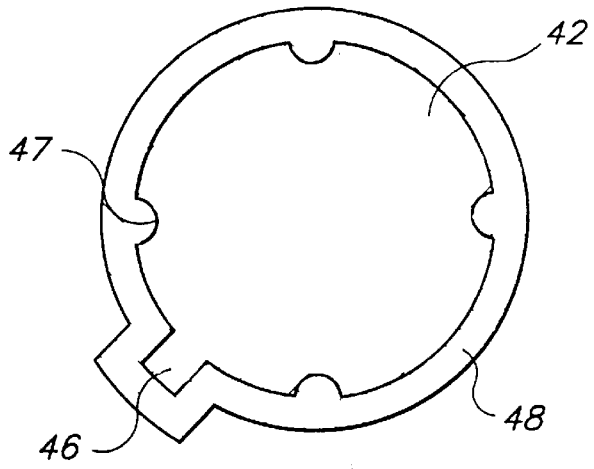
FIG. 5 is an enlarged diagrammatic representation of the bottom plan view of the forward bore.
Figure 6:
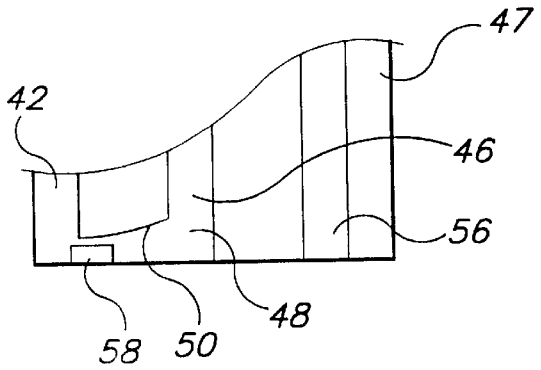
FIG. 6 is an enlarged, partial sectional view of the bottom of the forward bore showing a progressive cam surface.

The posterior member 18, as shown in FIG. 3, has a lower planar element 24 and peripheral walls 26 extending upwardly from the planar element 24 to form a trough 28. Juxtaposed within the planar element 24 is webbing 30 to enhance the structural integrity of the planar element 24. Moreover, gussets 32 extend between the planar element 24 and the peripheral walls 26 to enhance the structural integrity of the trough 28 to ensure that the trough 28 maintains its shape. The three branches 20, 20' comprise side branches 20 and an interior branch 20". These branches 20, 20' comprise a planar element 34, 34' and wall 36, 36' extending upwardly from the planar element 34, 34'. Webbing 38 extends between the interior branch 20' and the posterior member 18 to enhance the structural integrity of the posterior member 18 relative to the interior branch 20', and gussets 40 extend between the webbing 38 and the posterior member 18 to enhance the structural integrity of the webbing 38. The posterior member 18 and the branches 20, 20' are each provided with holes 41 which serve as weep holes and as openings through which anchors, such as stakes (not shown), may be received to permit the base 12 to be releasably affixed to a supporting surface. It is preferable that the branches 20, 20' extend substantially perpendicular from the posterior member 18. It is further preferable that the side branches 20 extend forwardly from the terminal ends of the posterior member 18 and that the interior branch 20' extends forwardly from a central point of the posterior member 18 and equidistantly between the side branches 20. The tower 22 extends upwardly from a central point of the posterior member 18 and preferably perpendicular therefrom. The webbing 38 extending between the interior branch 20' and the posterior member 18 and the gussets 40 further enhance the structural integrity of the tower 22 relative to the posterior member 18 to resist flexing of the tower 22 relative to the posterior member 18. The tower 22 is provided with bores 42, 44 fore and aft. The forward bore 42 includes a key slot 46 (shown in FIGS. 4 and 5) which terminates at the lower end of the bore 42. Four longitudinal ribs 47 extend equidistantly about and within the bore 42, and preferably the entire length of the bore 42. A channel 48 communicates with the key slot 46 and includes a progressive cam surface 50, as is shown in FIG. 6.

Figure 7:
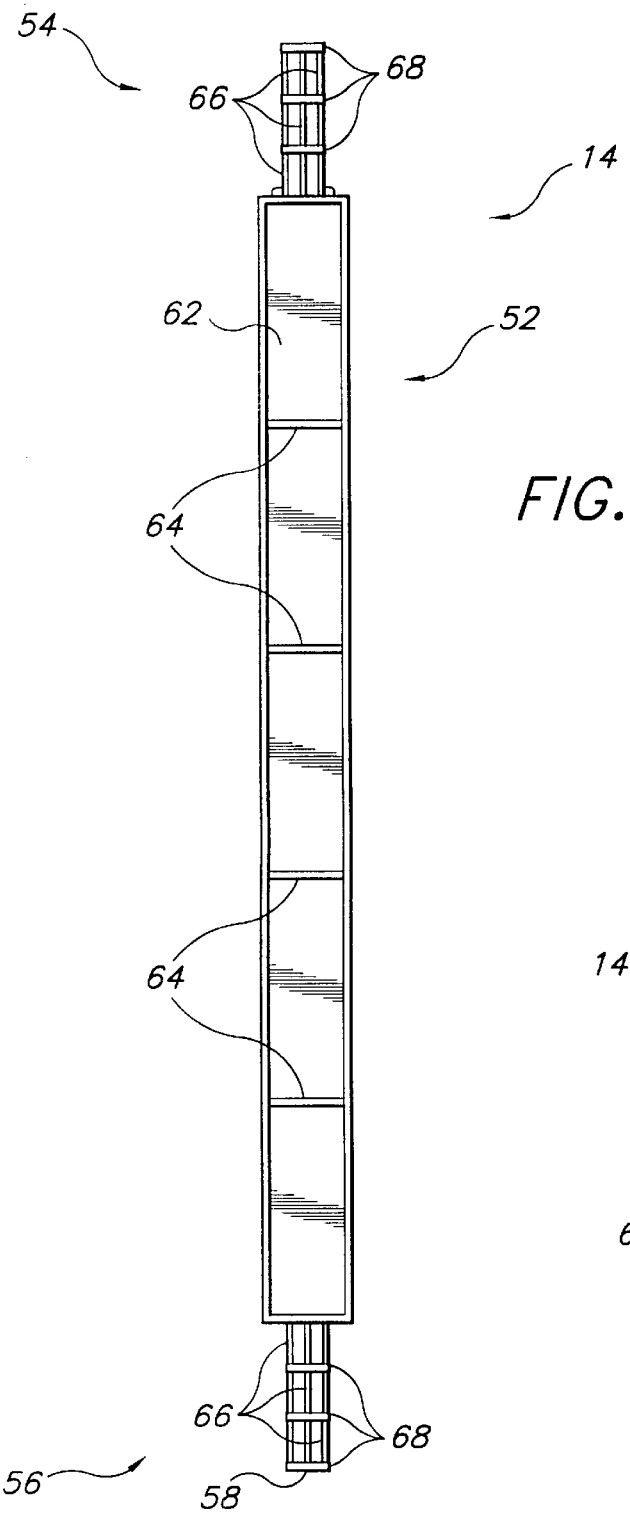
FIG. 7 is a rear elevational view of a standard according to the bag holder of the instant invention.
Figure 8:
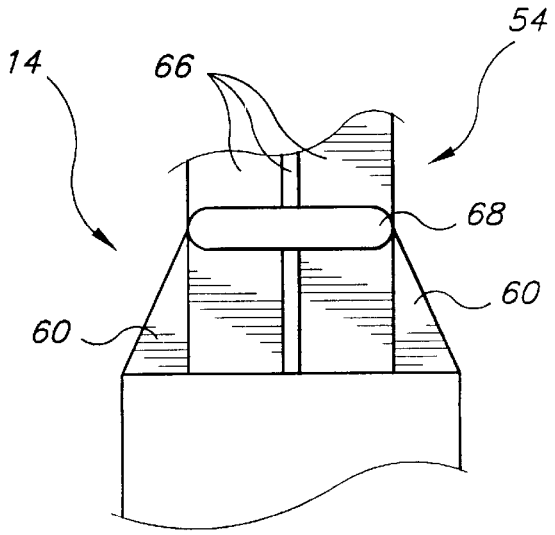
FIG. 8 is an enlarged, partial front elevational view of the upper end of the standard and upper projection extending therefrom.

A standard 14, as shown in FIG. 7, comprises an elongated member 52 having upper and lower ends and projections 54, 56 extending from the upper and lower ends. The lower projection 56 has a key 58 extending radially from its lower end. The projection 56 is removably insertable into the forward bore 42 in such a manner that the key 58 is received by the key slot 46. The bore 42 and projection 56 are dimensioned and configured to provide a snug fit therebetween. When the projection 56 is fully inserted into the forward bore 42, the key 58 aligns with the channel 48. Upon twisting the standard 14, the key 58 enters the channel 48 and cams against the cam surface 50. Upon progressing along the cam surface 50, the projection 56 is drawn tightly into the bore 42 and the lower end of the standard 14 is drawn snug against the upper surface of the tower 22. The webbing 38 and gussets 40 which resist flexing of the tower 22 also provide greater stability for the standard 14 engaging the tower 22. The upper projection 54 has disposed at its base, originating proximate the upper end of the standard 14, opposingly directed splines 60. The splines 60 extend radially and laterally from the projection 54 and taper upwardly. The purpose of these splines 60 is to be set forth in the following description of the support 16. It is preferable that the standard 14 has a hollow 62 with transverse web sections 64 spaced equidistantly in the hollow 62. In this way, the standard 14 may be produced having sufficient structural integrity and with less material consumption. Likewise, the projections 54, 56 preferably comprise an array of longitudinal and cylindrical elements 66, 68 structured and configured to form a substantially cylindrical structure with reduced material consumption. The tower 22 possesses substantially rounded corners and the anterior portion of the standard 14 likewise has substantially rounded comers. Upon fully engaging the standard 14 and the base 12, the rounded comers of the tower 22 align with those of the standard 14 to provide an indication that the standard 14 is fully engaged.

Figure 9:
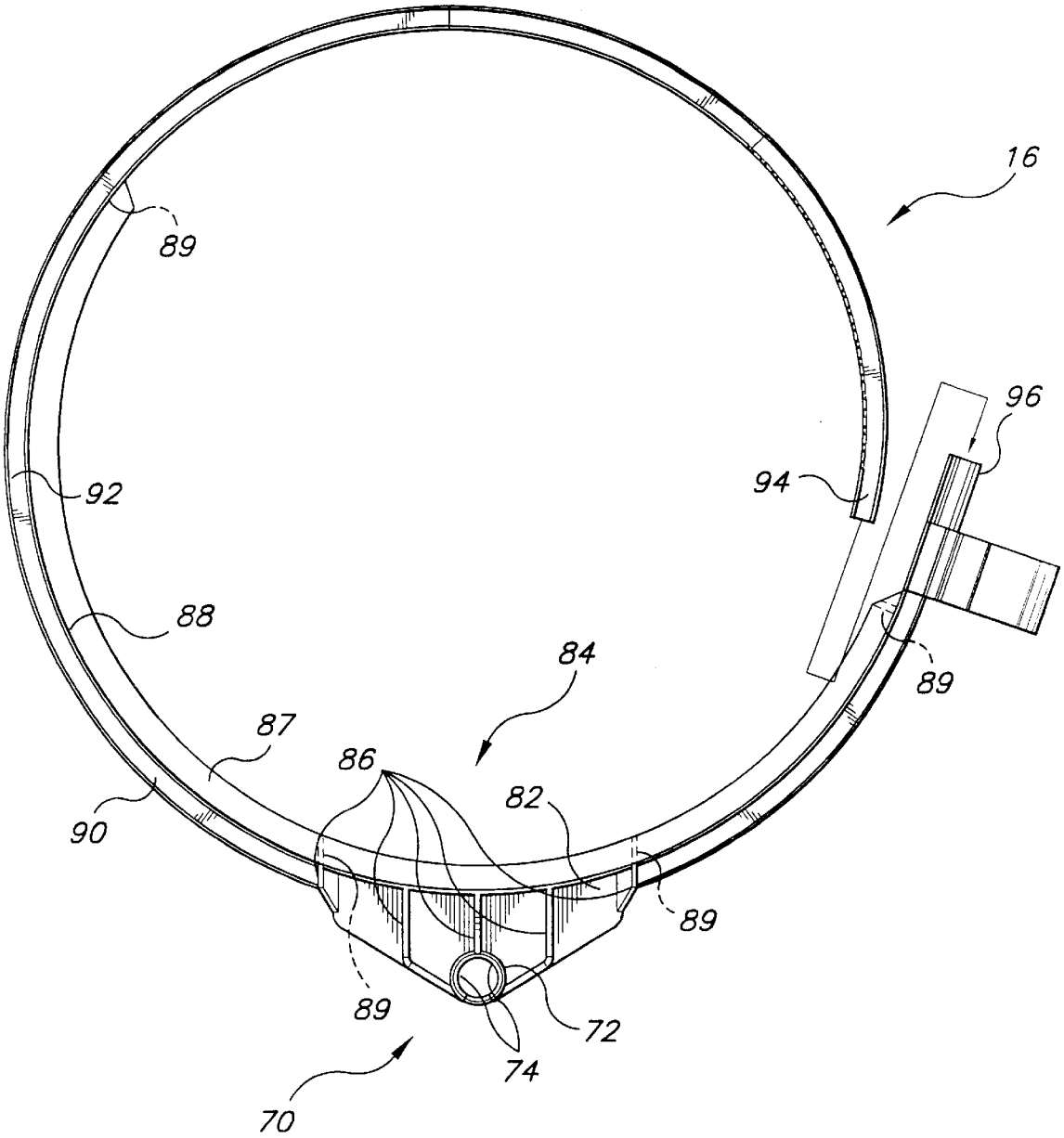
FIG. 9 is a bottom plan view of a support according to the bag holder of the instant invention.
Figure 10:
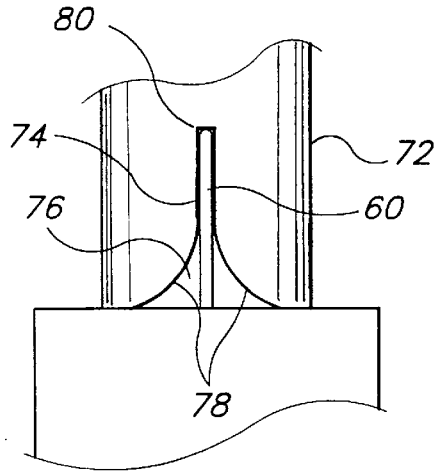
FIG. 10 is an enlarged, partial side elevational view of the upper projection extending from the upper end of the standard engaging the sleeve forming the handle of the support.
Figure 11:
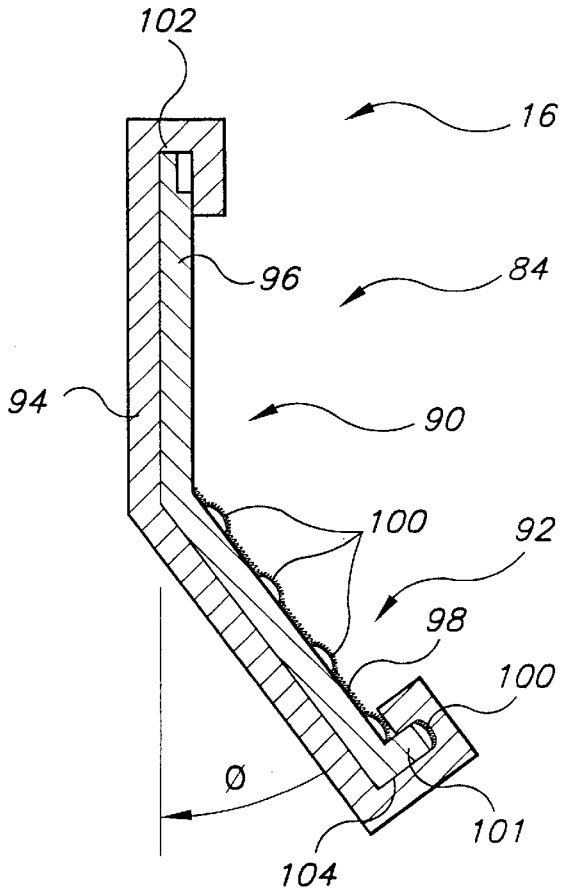
FIG. 11 is an enlarged, sectional view of the cylindrical element defining the ring of the support formed from a substantially upright peripheral wall, an angularly disposed lower flange, and slidably engageable ends.
Figure 12:
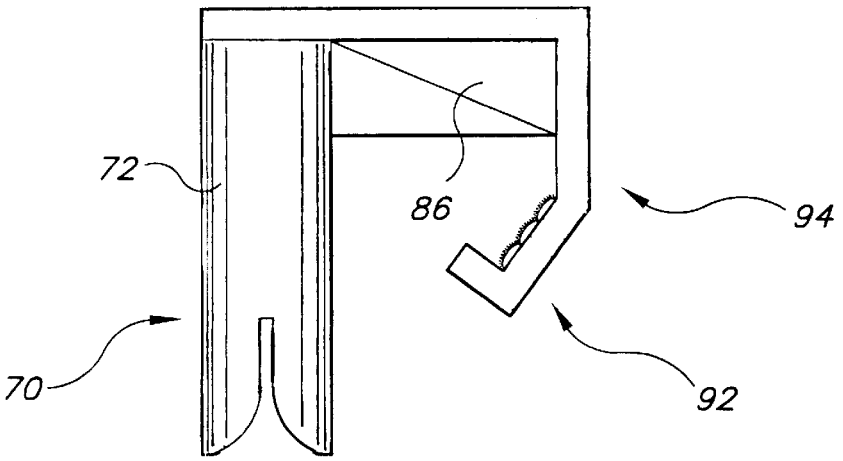
FIG. 12 is a partial diagrammatic representation of a side elevation of the handle and ring of the support and their interconnection and the structure and configuration of gussets reinforcing the interconnection.

The standard 14 releasably supports the support 16. The support 16, as shown in FIG. 9, comprises a handle 70 comprising a sleeve 72. The sleeve 72 has diametrically disposed slots 74 therein for receiving the splines 60. It is preferable that the slots 74 have an opening 76 at the base of the sleeve 72 that tapers to snugly engage the splines 60. It is further preferable that the opening 76 be defined by a cam surface 78 upon which the spline 60 may cam to assist the user in properly orienting the support 16 relative to the standard 14. To further enhance ease of engagement, the spline 60 may be provided with a rounded engaging surface 80 for engaging the cam surface 78. The sleeve 72 extends downwardly from planar member 82. The planar member 82 extends rearwardly and substantially perpendicularly from a ring 84. Gussets 86 extend between the ring 84 and the planar member 82 to enhance the structural integrity of the ring 84 relative to the planar member 42 and sleeve 72. Moreover, an internal lip 87 extends about the back of the inside of the ring 84, and gussets 89, as are more clearly shown in FIG. 16, extend between the lip 87 and the peripheral wall 90. A lip 87 in the order of one-half inch is sufficient. This arrangement and configuration is preferably suitable to maintain the ring 84 in a substantially horizontal plane. The ring 84 is formed of a broken cylindrical element 88 having a substantially upright peripheral wall 90, an angularly disposed lower flange 92, and slidably engageable ends 94, 96, as are more readily shown in FIG. 11. A cylindrical element 88 having an overall length of seventy-six inches provides a four inch overlap for the slidably engageable ends 94, 96 while permitting the cylindrical element to achieve a maximum radius of seventy-four inches. It is preferable that the ring 84 range in size from fifty-eight to seventy-two inches to accommodate plastic waste bags of varying capacity. Typical capacities for standard plastic waste bags range from twenty-nine to forty-nine gallons. The angle Ø of the flange 92 relative to the peripheral wall 90 is approximately 30 degrees. It is to be understood that the gussets 86 are structured and configured, such as is shown in FIG. 12, so as not to interfere with the bag (not shown) supported by the ring 84. Referring back to FIG. 11, the flange 92 has a rough surface 98 and an array of nodules 100 disposed thereon. The peripheral wall 90 may likewise be provided with a rough surface similar to that of the flange 92. It is preferable that the nodules 100 have a blunted point or rough surface (or both) to engage a bag supported by the ring 84. The outer lower edge of the flange 92 and the rough surface 98 and nodules 100 frictionally engage a the inner surface of a bag opening (not shown) upon expanding the ring 84. The lower edge of the flange 92 further includes a peripheral lip 101 having nodules 100 thereon. The lip serves to stiffen the flange 92 and engages a bag supported thereby to further enhance the grabbing sensation or the frictional engagement of the bag with the support 16. A lip 101 having a height of one-quarter inch and which protrudes one-eighth inch from the bottom of the flange 92 is sufficient to stiffen the flange 92. The slidably engagable ends 94, 96 of the ring 84 permit the ring 84 to be expandable. This configuration provides a support 16 to support a bag in a manner such that the support 16 substantially protects the opening of the bag (not shown) from damage resulting from the use, for example, of a rake in combination with the support 16. The sliding engagement of the ends 94, 96 is preferably accomplished as follows. It is preferable that the ends 94, 96 overlap forming an inner end 94 and an outer end 96 overlapping the inner end 94. The inner end 94 includes an upper and lower track 102, 104 for slidably receiving the outer end 96. The upper track 102 is disposed along an upper edge of the upright peripheral wall 90 and the lower track 104 is disposed along the lower edge of the flange 92. Located rearwardly of, and adjacent, the upper and lower tracks 102, 104 is a clamp 106, as is shown in FIG. 13, coupled to the flange 92 by a living hinge 108. The living hinge 108 is integral with the lower edge of the flange 92 at a point adjacent the lower track 104. The clamp 106 is dimensioned and configured to complement the upright peripheral wall 90 and adjoining flange 92 such that, upon closing the clamp 106 against the upright peripheral wall 90 and flange 92, the clamp 106 conforms to the surface configuration of the same. The upper end of the clamp 106, opposite the living hinge 108, comprises a flexible yet rigid fold 110 which releasably engages the upper edges of the slidably engaged ends 94, 96. Located inside the fold 110 is an inwardly directed nodule 112. The upper edge of the outer end 96 of the ring 84 is provided with a series of notches 114. The nodule 112 is structured and dimensioned to engage a notch 114 upon closing the clamp 106. This arrangement maintains the ring 84 in a desired expanded posture to snugly and securely hold a bag (not shown) in contact with the ring 84.

The instant invention is preferably fabricated of a plastic material, such as polypropylene or polystyrene. The base 12 and standard 14 may be produced via a gas assisted foaming process to produce a strong cell structure which is 10–20 percent lighter in weight. The support 16 may be formed from a calcium polypropylene composition to ensure that the support 16 retains its shape, even in warm environments, and to reduce the risk of the ring 84 sagging or drooping when the support 16 is supported by the standard 14. Various segments of the ring 84 should be of varying thicknesses.

For example, the rear half of the ring 84 should be suitably thick to maintain its circular shape, and the front of the ring 84 should be of a suitable thickness to permit the front of the ring 84 to substantially collapse or flatten when in use and pressed against a working surface, such as the ground. It is also preferable that the handle 70 be located at the back of the ring 84, and that the slidably engagable ends 94, 96 and clamp 106 be located at the side of the ring 84 substantially ninety degrees from the front of the ring 84. This arrangement allows the support 14 to be easily controlled by the handle 70, and precludes intended deformation of the front of the ring 84 from disturbing the utility of the slidably engaged ends 94, 96 and clamp 106.

The instant invention may further include a pan 116. The pan 116 according to the instant invention comprises a trough 118 having an opening end 120, a handle 122, and a rake 124 disposed at the open end 120 of the trough 118. The trough 118 is formed of a planar member 126 having integral rear and side walls 128, 130. The handle 122 extends rearwardly of the rear wall 128 of the trough 118. Gussets 132 engaging the planar member 126 and the rear wall 128 of the trough 118 opposite the handle 122 enhance the structural integrity of the rear wall 128. The handle 122 is preferebly formed in a manner similar to that of the projections 54, 56 set forth above except it is preferable that the bottom of the handle 122 be ergonomically shaped and configured to comfortably fit the user's hand. The handle 122 is further dimensioned and configured to removably be received snugly by the bore 44 aft of the tower 22 for storing the same. The rake 124 at the open end 120 of the trough 118 is formed of a series of rigid fingers 134 extending forwardly of, and lying in the same plane as, the planar member 126. Similar to the bag holder 10 set forth above, the pan 116 is preferably fabricated of a plastic material, such as polypropylene or polystyrene.

Figure 15:
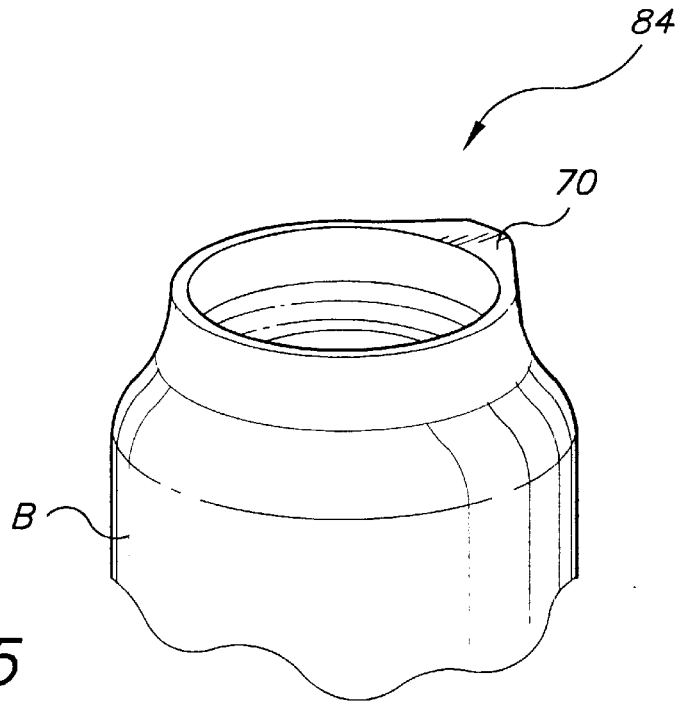
FIG. 15 is a partial environmental perspective view of the bag holder supporting a plastic bag with directional lines indicating the movement of the ring and clamp.
Figure 16:
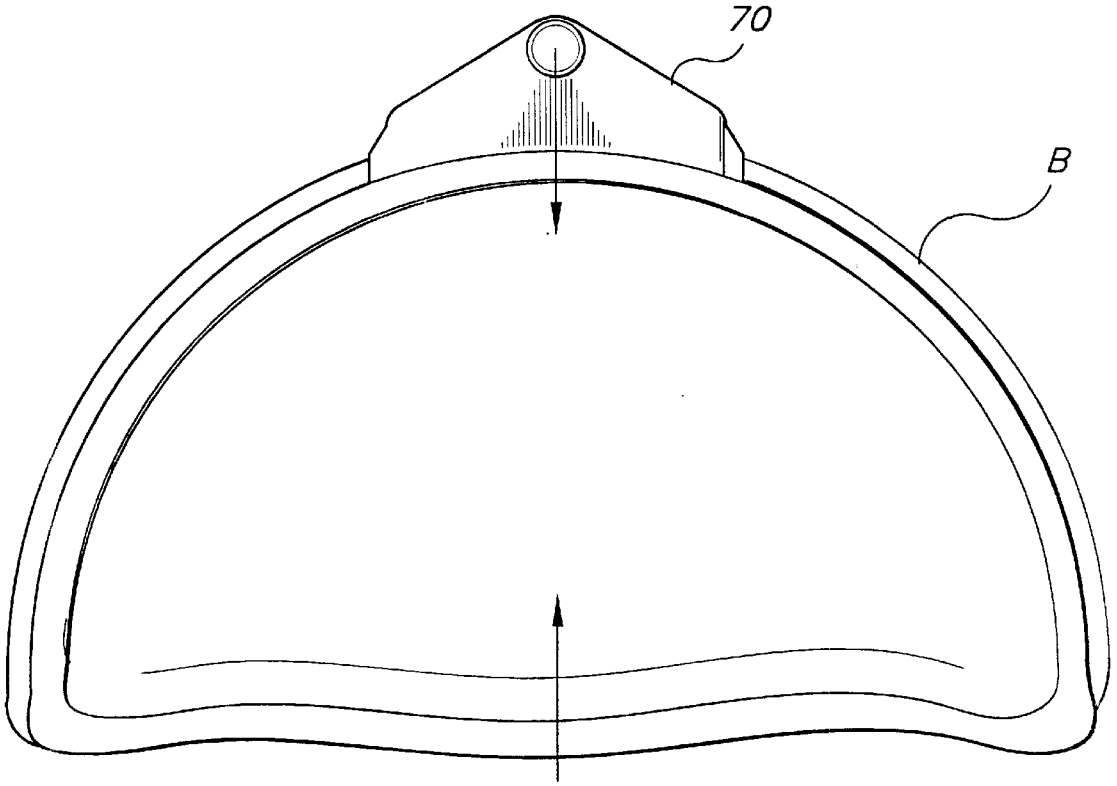
FIG. 16 is a partial environmental perspective view of the bag holder supporting a plastic bag showing the ring distorted to conform to the shape of a work surface and directional lines indicating the direction upon which force is exerted to distort the ring.
Figure 17:
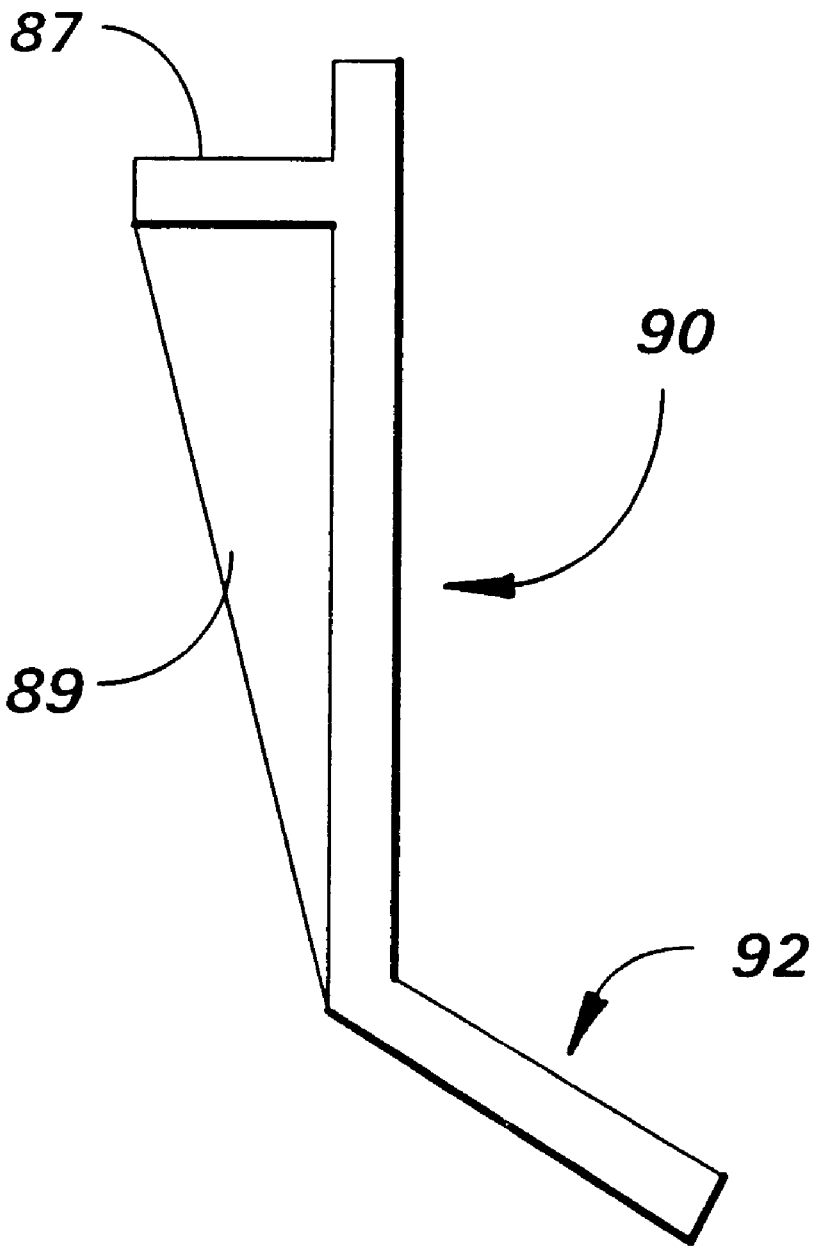
FIG. 17 is a diagrammatic sectional view of the ring of the support, and an internal lip and gusset integral with the inner surface of the peripheral wall of the ring.

The operation of the instant invention is set forth as described above and further as follows. The bag holder 10 may be broken down in a compact form and assembled to support the support 14 and the pan 116. With the clamp 106 released, the ring 84 is collapsible to fit within the open end of a bag, such as the plastic bag B shown in FIG. 15. With the ring 84 in the open end of the bag B, the ring 84 is expanded substantially tight against the bag B. As this is done, the bag B will naturally begin to close the clamp 106. When the ring 84 is expanded to a desired size, the clamp 106 is tightly closed by pulling the fold 100 of the clamp 106 over the slidably engaged, overlapping ends 94, 96 forming the ring 84. As this is accomplished, the nodule 112 in the fold will readily engage a notch 114 in the upper edge of the outer end 96 of the ring 84 to hold the ring 84 in its expanded posture. With the bag B supported by the support 16, the support 16 can remain engaged with the standard 14, permitting the user to load the bag B while supported upright. Alternatively, the user can detach the support 16 from the standard 14 and control the support 16 with the handle 70. In this way, the user can turn the support so as to lay the bag B adjacent a work surface, such as the ground, and apply pressure with the handle 70 to distort the front of the ring 84, substantially flattening the ring 84 against the ground, as is shown in FIG. 16. With a tool, such as a rake (not shown) or the pan 116 set forth above, the user can fill the bags with debris from the work surface. Because the bag B is supported by the outside of the ring 84, the bag B is substantially protected against damage resulting from the tool. As the bag B approaches being filled, the support 16 may be engaged with, and supported by, the standard 14 and then filled to its capacity. Subsequently, the ring 84 may be collapsed and the bag B tied, closed and disposed.

It is to be understood that the present invention is not limited to the sole embodiment described above, but encompasses any and all embodiments within the scope of the following claims.

We claim:

1. A bag holder comprising a support, the support comprising:

a peripheral wall having two ends, one of said ends being slidably engageable with another one of said ends, and a flange extending angularly downward and outward from said peripheral wall, said peripheral wall and said flange cooperatively form a ring.

2. The bag holder according to claim 1, wherein said flange extends angularly downward and outward from said peripheral wall at an angle 30 degrees relative to said peripheral wall.

3. The bag holder according to claim 1, wherein said flange has a bag engaging surface, said bag engaging surface being sufficiently rough so as to frictionally engage a bag supported by said ring.

4. The bag holder according to claim 1, further including an array of nodules disposed on said flange, each one of said nodules being arranged and configured to frictionally engage a bag supported by said ring.

5. The bag holder according to claim 4, wherein each one of said nodules has a blunted point structured and configured to engage a bag supported by said ring.

6. The bag holder according to claim 5, wherein each one of said nodules has a surface sufficiently rough so as to frictionally engage a bag supported by said ring.

7. The bag holder according to claim 1, wherein said flange comprises:

lower edge, and a peripheral lip on said lower edge of said flange.

8. The bag holder according to claim 7, further including a plurality of nodules on said peripheral lip of said flange.

9. The bag holder according to claim 1, wherein said ring comprises:

a first end and a second end, said first end being slidably engageable with said second end to permit said ring to be varied in dimension.

10. The bag holder according to claim 9, wherein said ring comprises: an upper and lower edge, and wherein said first end of said ring comprises:

an upper groove disposed along said upper edge, and a lower groove disposed along said lower edge and opposite said upper groove, said upper and lower grooves cooperate to slidably receive said second end of said ring.

11. The bag holder according to claim 10, further including:

a clamp located proximate said first end and adjacent to said upper and lower grooves.

12. The bag holder according to claim 11, wherein said clamp is coupled to said ring by a hinge.

13. The bag holder according to claim 12, wherein said hinge is a living hinge, said living hinge being integral with said ring at a point substantially adjacent to said lower track.

14. The bag holder according to claim 12, wherein said clamp comprises:

a lower end defined by said hinge, and an upper end opposite said lower end, said upper end comprising a fold which is releaseably engageable with said upper edge of said ring.

15. The bag holder according to claim 14, further comprising:

an inwardly directed nodule located adjacent said fold, and wherein said upper edge of said peripheral wall comprises:

an outer surface, and a series of notches in said outer surface, said nodule being structured and dimensioned to engage at least one of said notches upon closing said clamp.

16. The bag holder according to claim 11, wherein said slidably engageable ends and said clamp are located at a point proximate a side of said ring.

17. The bag holder according to claim 9, further including:

a clamp located proximate one of said ends of said ring.

18. The bag holder according to claim 16, wherein said clamp is coupled to said ring by a hinge.

19. The bag holder according to claim 18, wherein said ring further includes a lower edge and said hinge is a living hinge, said living hinge being integral with said lower edge of said ring at a point substantially adjacent one of said ends.

20. The bag holder according to claims 18, wherein said clamp comprises:

a lower end defined by said hinge, and an upper end opposite said lower end, said upper end comprising a fold, and wherein said ring further comprises an upper edge, said fold being releasably engageable with said upper edge of said ring.

21. The bag holder according to claim 20, further comprising:

an inwardly directed nodule located adjacent said fold, and wherein said upper edge of said ring has an outer surface, and a series of notches in said outer surface of said upper edge of said ring, said nodule being structured and dimensioned to engage at least one of said notches upon closing said clamp.

22. The bag holder according to claim 17, wherein said slidably engageable ends and said clamp are located at a point proximate a side of said ring.

23. The bag holder according to claim 17, wherein said ring has a predetermined shape and said clamp is dimensioned and configured to complement said shape of said ring.

24. The bag holder according to claim 11, wherein said ring has a predetermined shape and said clamp is dimensioned and configured to complement said shape of said ring.

25. The bag holder according to claim 1, further including. a clamp located proximate one of said ends of said peripheral wall.

26. The bag holder according to claim 25, wherein said clamp is coupled to said peripheral wall by a hinge.

27. The bag holder according to claim 26, wherein said hinge is a living hinge.

28. The bag holder according to claim 27, wherein said clamp comprises a lower end defined by said hinge, and an upper end opposite said lower end, said upper end comprising a fold, and wherein said peripheral wall further comprises an upper edge, said fold being releasably engageable with said upper edge of said peripheral wall.

29. The bag holder according to claim 28, further comprising:

an inwardly directed nodule located adjacent said fold, and wherein said upper edge of said peripheral wall has an outer surface, and a series of notches in said outer surface of said upper edge of said peripheral wall, said nodule being structured and dimensioned to engage at least one of said notches upon closing said clamp.

30. The bag holder according to claim 1, being fabricated of a plastic material.

31. The bag holder according to claim 30, wherein said plastic material is polypropylene.

32. The bag holder according to claim 30, wherein said plastic material is polystyrene.

33. The bag holder according to claim 1, wherein said support is fabricated from a calcium polypropylene composition.

34. The bag holder according to claim 1, further comprising:

a standard, said support being engageable with said standard to hold said support in an elevated position.

35. The bag holder according to claim 34, wherein said standard comprises:

a hollow interior, and transverse web sections spaced apart in said hollow interior.

36. The bag holder according to claim 34, further comprising:

a base, said standard being attachable to said base to hold said base in an upright posture.

37. The bag holder according to claim 36, wherein said base comprises:

a longitudinal posterior member, a plurality of spaced apart branches extending forwardly from said posterior member and substantially in the same plane as said posterior member, and a tower extending upwardly from said posterior member, said standard being engageable with said tower to attached said standard to said base.

38. The bag holder according to claim 37, wherein said posterior member comprises:

a lower planar element, and peripheral walls extending upwardly from said planar element, said lower planar element and said peripheral walls defining a trough.

39. The bag holder according to claim 37, wherein said plurality of spaced apart branches comprises:

two side branches and an interior branch intermediate said two side branches, each one of said branches comprises a planar element and a wall extending upwardly from said planar element.

40. The bag holder according to claim 37, wherein said posterior member and said branches each include a hole therein.

41. The bag holder according to claim 37, wherein said posterior member comprises:

two opposingly disposed terminal ends, and a central point, said side branches extending forwardly from said terminal ends of said posterior member and said interior branch extending forwardly from said central point of said posterior member and equidistantly between said side branches.

42. The bag holder according to claim 41, wherein said tower extends upwardly and perpendicularly from said central point of said posterior member.

43. The bag holder according to claim 49, wherein said tower comprises:

a bore having a lower end, and a key slot communicating with said bore, said key slot terminating at said lower end of said bore, and wherein said standard comprises:

an elongated member having a lower end, and a lower projection extending from said lower end of said elongated member.

44. The bag holder according to claim 43, further comprising: a channel communicating with said key slot, said channel being defined at least in part by a progressive cam surface, said progressive cam surface being structured and configured such that, upon fully inserting said lower projection of said standard into said bore, said key extending from said lower projection aligns with said channel and thereafter, upon twisting said standard, said key enters said channel and engages said cam surface, drawing said lower projection tightly into said bore in said tower and further drawing said lower end of said standard snug against said tower.

45. The bag holder according to claim 44, wherein said projection extending from said lower end of said standard has a key extending radially therefrom, said key being engageable with said key slot.

46. The bag holder according to claim 37, wherein said standard further comprises:

an anterior portion having a predetermined shape, and said tower further comprises:

an interior portion having a predetermined shaped substantially complementary to said shape of said standard, whereby upon fully engaging said standard and said base, said shape of said anterior portion of said standard substantially aligns with said shape of said anterior portion of said tower to provide an indication that said standard and said tower are fully engaged.

47. The bag holder according to claim 37, wherein said standard and said base are produced via a gas-assisted foaming process to provide a strong, substantially lightweight cell structure.

48. The bag holder according to claim 37, further comprising:

a standard, said support being engageable with said standard to hold said support in an elevated position, and a base, said standard being engageable with said base to hold said standard in an upright posture, said base including a tower, said tower being dimensioned and configured to removably receive and store said handle.

49. The bag holder according to claim 34, wherein said support further comprises:

a handle defined by a sleeve, said sleeve having diametrically disposed slots therein, and wherein said standard comprises:

an elongated member having an upper end, an upper projection extending from said upper end of said elongated member, and opposingly directed splines extending radially and laterally from said upper projection, said opposingly directed splines being engageable with said diametrically disposed slots in said sleeve.

50. The bag holder according to claim 49, wherein said sleeve further comprises;

a base, and each one of said slots in said sleeve comprises an opening at said base of said sleeve for receiving a respective one of said splines extending from said upper projection of said standard, each one of said slots further tapering upwardly from said opening to snugly engage said spline received therein.

51. The bag holder according to claim 50, wherein said opening is defined at least in part by a cam surface upon which said spline may engage to assist a user in properly orienting said support relative to said standard upon engaging said support and said standard.

52. The bag holder according to claim 51, wherein said spline is provided with a rounded engaging surface for engaging said cam surface.

53. The bag holder according to claim 34, wherein said standard comprises:

an elongated member having an upper end and a lower end, an upper projection extending from said upper end of said elongated member, and a lower projection extending from said lower end of said elongated member, said upper and lower projections being defined by an array of longitudinal and cylindrical elements structured and configured to form a substantially cylindrical elongated structure.

54. The bag holder according to claim 1, further comprising a pan.

55. The bag holder according to claim 54, wherein said pan comprises:

a trough having an open end, said trough being formed of a planar member having integral rear and side walls, a handle extending rearwardly of said rear wall of said trough, and a rake disposed at said open end of said trough.

56. The bag holder according to claim 55, further including gussets engaging said planar member and said rear wall of said trough opposite said handle.

57. The bag holder according to claim 55, wherein said rake includes a series of substantially rigid fingers extending forwardly of said planar member and substantially lying in the same plane as said planar member.

58. The bag holder according to claim 54, wherein said pan is fabricated of a plastic material.

59. The bag holder according to claim 54, wherein said plastic material is polypropylene.

60. The bag holder according to claim 54, wherein said plastic material is polystyrene.

61. A bag holder comprising a support, the support comprising:

a peripheral wall having two ends, one of said ends being slidably engageable with another one of said ends, a ring comprising a substantially upright peripheral wall, a planar member extending rearwardly and substantially perpendicularly from said peripheral wall, and a handle defined by a sleeve extending downwardly from said planar member.

62. The bag holder according to claim 61, further comprising:

a plurality of gussets extending between said ring and said planar member.

63. The bag holder according to claim 61, wherein said ring comprises:

a back portion having an inside surface, and an internal lip extending from an inside surface of said back portion of said ring.

64. The bag holder according to claim 63, further comprising:

a plurality of gussets extending between said internal lip and said peripheral wall.

65. The bag holder according to claim 61, wherein said peripheral wall comprises a bag engaging surface, said bag engaging surface being sufficiently rough so as to frictionally engage a bag supported by said ring.

66. A bag holder comprising a support the support comprising:

a peripheral wall having two ends, one of said ends being slidably engageable with another one of said ends, and a substantially rigid rear portion, and a substantially pliable front portion, whereby upon pressing said support against a work surface, said rear portion of said support maintains a substantially semi-circular shape and said front portion of said support substantially conforms to the work surface upon which said support is pressed.

67. A bag holder comprising:

a support comprising a peripheral wall having overlapping ends, one of said ends defining a tongue and another one of said ends having a clamp hingedly attached thereto, said clamp being cooperatively engageable with said tongue, said overlapping ends being displaceable relative to each other upon disengaging said clamp and said tongue and fixed relative to each other upon engaging said clamp with said tongue.

68. The bag holder according to claim 67 wherein the peripheral wall has a lower edge; and a flange extends outwardly from said lower edge of said peripheral wall.

* * * * *

UNITED STATES PATENT AND TRADEMARK OFFICE

CERTIFICATE OF CORRECTION

PATENT NO : 5,899,419

DATED : May 4, 1999

INVENTOR(S): Jaye F. Ross, Ted Torok; Jeff R. Ellis

It is certified that error appears in the above-identified patent and that said Letters Patent is hereby corrected as shown below:

At column 1, line 38, "Ilinsky", should be --Ilnisky--

At column 2, line 4, "Support", should be --support--

At column 6, line 16, eliminate "a" after "engage"

At column 9, line 21, "claims 18" should be --claim 18--

At column 11, line 1, according to claim "49" should be --37--

Signed and Sealed this

Twenty-seventh Day of June, 2000

*Attest:*

Q. TODD DICKINSON

*Attesting Officer*

*Director of Patents and Trademarks*